US005826876A

United States Patent [19]

Wagner

[11] Patent Number: 5,826,876

[45] Date of Patent: Oct. 27, 1998

[54] FIELD OR BOARD GAME AND METHOD OF PLAY

[76] Inventor: Marcus L. Wagner, 10214 Angora Dr., Alexandria, Va. 22314

[21] Appl. No.: 826,671

[22] Filed: Apr. 7, 1997

[51] Int. Cl.[6] ..... A63F 3/00; A63B 67/00

[52] U.S. Cl. ..... 273/244; 273/248; 473/415

[58] Field of Search ..... 273/243, 244, 273/248, 261, 441, 444; 473/415

[56] References Cited

U.S. PATENT DOCUMENTS

| | | | |
|---|---|---|---|
| D. 212,102 | 8/1968 | Hawkins . | |
| 611,758 | 10/1898 | Murphy . | |
| 676,581 | 6/1901 | Fuller . | |
| 1,295,993 | 3/1919 | Kleissl . | |
| 3,870,311 | 3/1975 | Klupp . | |
| 3,948,521 | 4/1976 | Warren . | |
| 4,052,064 | 10/1977 | Kennoy . | |
| 4,186,928 | 2/1980 | Hunt, Jr. . | |
| 4,211,413 | 7/1980 | Arzola . | |
| 4,260,154 | 4/1981 | Balbastro . | |
| 4,453,720 | 6/1984 | King . | |
| 4,482,157 | 11/1984 | McNeil . | |
| 4,781,385 | 11/1988 | Harley . | |
| 4,792,144 | 12/1988 | LaDue . | |
| 4,895,375 | 1/1990 | Blitz et al. . | |
| 4,911,443 | 3/1990 | Foster . | |
| 5,129,651 | 7/1992 | Tobias | 273/244 X |
| 5,328,191 | 7/1994 | Taylor, Jr. . | |
| 5,540,440 | 7/1996 | Liu | 273/244 X |
| 5,582,409 | 12/1996 | Mayorga et al. | 273/244 |

OTHER PUBLICATIONS

Wall Street Journal Article; In Sports, Americans Set the World Pace in Inventing New Ones; Dec. 18, 1996.

Physical Education Handbook; 1974; "Athletic Field and Court Diagrams"; pp. 432–437.

Games for Boys and Girls; 1951; "Tag Games"; pp. 104–112; Ball Games; pp. 133–156.

*Primary Examiner*—William E. Stoll

*Attorney, Agent, or Firm*—James W. Pravel

[57] ABSTRACT

A new field game and board game on which the field game rules are applied is disclosed. In the field game an offensive team and a defensive team oppose each other. The offensive team is divided into an equal number of carrier players and escort players. The carrier players attempt to remove an object from the center marker located in the center of a round or oval playing area. The defensive players attempt to tag-out the carrier player while the escort player attempts to simultaneously tag-out the defensive players. The offensive team scores by either successfully removing the object from the field or by tagging-out all of the defensive players. If the offensive team does not score, the offense and defense change roles. The game continues to be played round by round until a predetermined number of points is reached. The field game offers the advantages of providing a game that demands stamina, agility and mental quickness without requiring elaborate or expensive equipment for the players or for the field.

11 Claims, 3 Drawing Sheets

FIELD OR BOARD GAME AND METHOD OF PLAY

FIELD OF THE INVENTION

The present invention relates generally to games. In particular, the invention relates to field games and methods of playing field games. The invention also relates to board games and methods of playing board games.

BACKGROUND OF THE INVENTION

There are numerous examples of field games today. Most of the field games played today require extensive personal equipment for the players and large goal assemblies for the field. The oldest organized field game played in North America is lacrosse. Lacrosse is played with ten (10) players on a team. Each player carries a crosse. A crosse is a stick shaped like a long handled tennis racket. Each player wears a padded helmet and a wire face mask for protection from an accidental blow from a crosse. After a "face-off" between players from each side at the beginning of a quarter of play, the opposing teams attempt to get a ball into the other team's goal. The goals on each end of the field are six (6) feet wide by six (6) feet tall.

Rugby is another popular and well known field game. According to legend, the fundamental idea of rugby was conceived in 1823 during a soccer game in England where a frustrated soccer player picked up the soccer ball and ran with it toward the goal. The rules were then refined and divided into two types of rugby: amateur and professional. A rugby team includes eight (8) or ten (10) players. The scrum, or scrummage, is the method of putting the ball in play from a set formation between two opposing teams. The ball is thrown on the ground between the two teams and each team tries to gain possession of the ball. A tackle occurs when a player carrying the ball is sent to the ground or is held immobile by one or more opponents. Scoring is achieved by touching the ball down in the opponent's goal area, or by kicking the ball over the crossbar between the opponents' goalposts. The goalposts positioned on each end of the playing field are eighteen and one-half (18½) feet apart and are connected with a crossbar ten (10) feet above the ground.

The world's most popular team sport that is played on a field is soccer. Virtually every country on Earth plays soccer in one form or another. There are records of soccer-like games having been played in China more than 2,000 years ago as well as in ancient Greece, Japan and Mexico. Uniform rules for soccer were not created until 1863 in England. The first international game of soccer was played between England and Scotland in 1872. In soccer there are eleven (11) players to a team—a goalkeeper and ten field players divided into defenders (fullbacks), midfielders (halfbacks), and forwards. The purpose of the game is to propel a leather covered inflated ball into the opponent's goal, using only the feet, head, or body. The goals on each end of the field are twenty one (21) feet wide and eight (8) feet high.

In the United States, the most popular team sport that is played on a field is football. The American brand of football developed from rugby. Soccer does not allow the hands to touch the ball. In rugby and American football however, running with the ball in hand, throwing it, and kicking it are all allowed. Unlike in rugby, American football allows forward passing, or throwing the ball toward the opponent's goal. Furthermore, running strategies based upon a preplanned set of plays are an important aspect of American football but are not featured in rugby. American football is played by eleven (11) man teams. The players wear extensive protective equipment. In high school and college football games, the width between the goal posts is twenty three (23) feet, four (4) inches and the uprights of the goalposts must be at least twenty (20) feet in all. In professional football games, the width between the goal posts is eighteen (18) feet, six (6) inches and the uprights extend thirty (30) feet above the crossbar.

What is needed is a field game that provides novel rules based upon a specific even number of offensive and defensive players. The game should be playable by a relatively small number of players so that it does not become difficult to find enough people to play the game. The game should demand stamina, agility and mental quickness without requiring elaborate or expensive equipment for the players or for the field. The game should be adaptable to be playable with teams of individual players who are equipped with a variety of means of mobility. The players should be able to wear shoes with cleats, play on bicycles, play on in-line skates or play the game while operating a watercraft. The rules of the game should also be adaptable to be used on board games.

There are also examples of methods of playing field games that have been adapted to be played as board games. For example, U.S. Pat, No. 4,186,928 shows a simulated basketball game that is played on a board. It is desirable to adapt the present method to be played upon a corresponding board.

SUMMARY OF THE INVENTION

The present invention involves a game having a unique set of rules that in a preferred embodiment, is played on a generally flat field. The game is played by two opposing teams of players. One of the teams is offensive and the other is defensive. The number of players on each team is equal and the number of players on each team is an even number. Typically, there are two players per team. The playing area is generally defined by a circle of a desired dimension. It is contemplated that the playing surface can be of any desired annular shape such as an oval other variation. The playing area includes hash marks separated by approximately ninety degrees. A relatively small square or rectangular center marker is placed at the center of the playing area. The center marker generally contains enough area for the defensive team members to fit within the center marker. A ball or other playing object is placed in the center marker. The offensive team is comprised of an even number of players. One half of the offensive team functions as an escort. The other half of the offensive team functions as a carrier. At the start of each round of play, the defensive players position themselves within the center marker. The offensive players position themselves on the perimeter of the playing area separated by approximately ninety degrees as indicated by the hash marks on the perimeter of the playing field. The offensive players typically begin play on the outside of the perimeter but it is conceivable that they could begin inside of the perimeter. The carrier's objective is to remove the playing object from the playing field. The defensive players' objective is to tag-out the carrier during the attempt to remove the playing object. The escort's objective is to tag-out all of the defensive players before they are able to tag-out the carrier. As explained in more detail hereinafter, a round of play may be ended in several different ways. The number of rounds of play may be determined according to the preferences of the players.

The present invention offers the advantage of requiring a relatively small number of players. This helps to make it easy to find enough people to play the game.

Another advantage of the present invention is that it demands stamina, agility and mental quickness without requiring elaborate or expensive equipment for the players or for the field. If desired, the game can be played on a playing field marked off in accordance with the details of the invention by players wearing only a uniform and shoes with cleats or running shoes.

The invention also allows players to adapt the game to be played on any mobile apparatus such as bicycles, conventional skates, in-line skates, or watercraft such as jet skis.

Yet another advantage of the present invention is that it can be played in an open area without the need to construct elaborate goal posts or goal systems.

The present invention also discloses a board game that is based upon the method of playing the inventive field game. The board game also includes an equal, even number of defensive and offensive player pieces. The offensive pieces are further defined to include an offensive, carrier piece and an offensive escort piece. The player pieces move one space at a time on the board in a pre-arranged order. Rules that are based upon the field game rules are used to play the board game.

DETAILED DESCRIPTION OF PREFERRED EMBODIMENT

Description of the Playing Field

Figure 1:
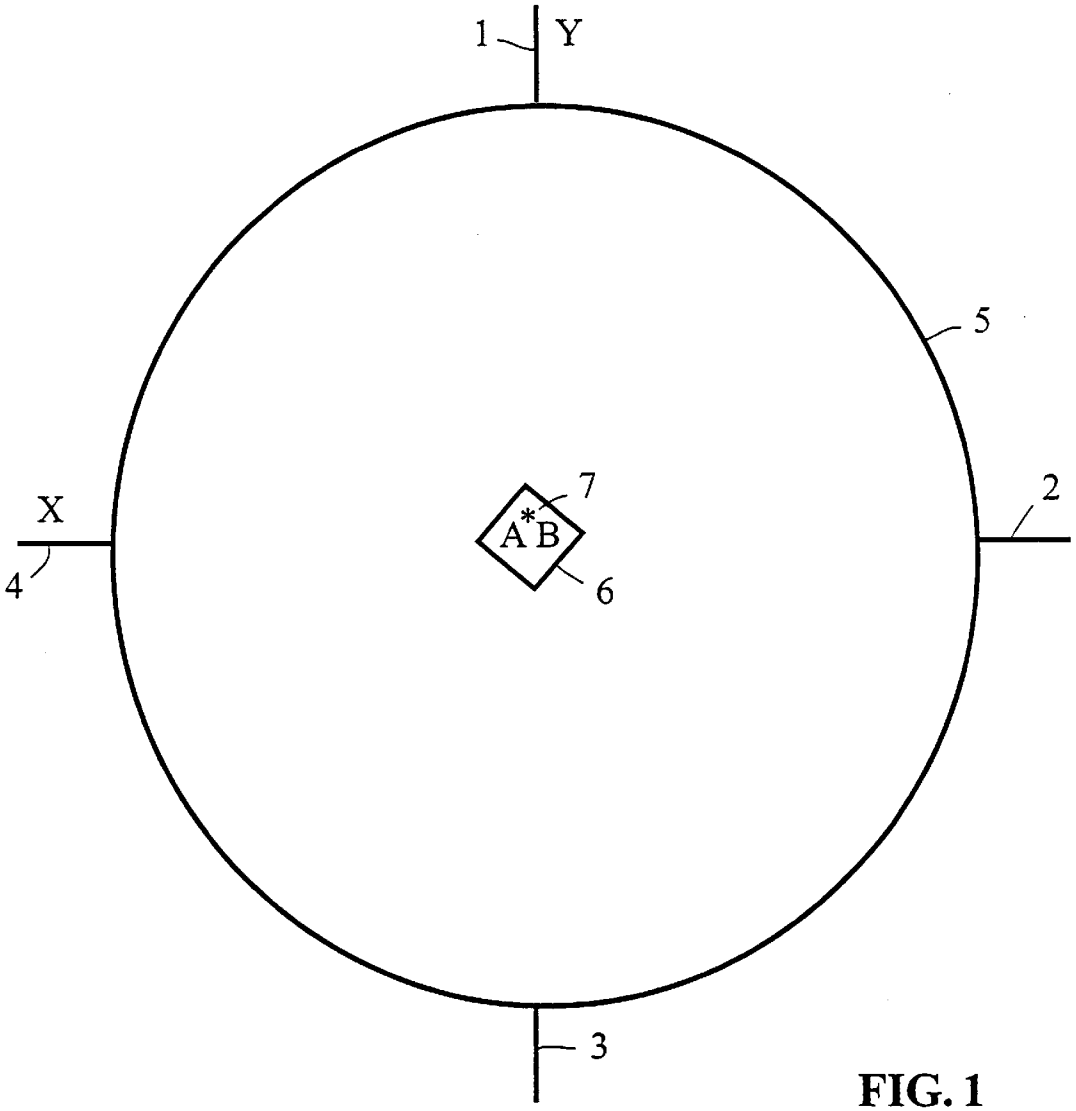
FIG. 1 is a diagrammatic top plan view of the playing field showing four (4) players in the designated starting positions.

In FIG. 1, a circular playing area is shown. The playing area may be circular or oval. In a preferred embodiment, the playing area is approximately 85 yards in diameter. The line that defines the circle or oval is approximately three (3) to five (5) inches wide. Hash marks 1, 2, 3, 4 are positioned about the perimeter 5 of the playing area. The hash marks 1, 2, 3, 4 extend approximately eighteen (18) inches from the perimeter 5 of the playing area. The hash marks 1, 2, 3, 4 are each positioned approximately ninety (90) degrees away from the next closest hash mark. Located at the center of the playing area is a center marker 6 that is square or rectangular in shape. The center marker 6 may also be circular or triangular.

Table of Playing Field Elements and Players

The following table lists and describes the individual elements illustrated in the Figures and more fully explained throughout this specification:

| Element or Player: | Description: |
|---|---|
| X | Offensive Player, Carrier |
| Y | Offensive Player, Escort |
| A, B | Defensive Players |
| 1, 2, 3, 4 | Hash Marks |
| 5 | Perimeter of Playing Area |
| 6 | Center Marker |
| 7 | Playing Object |

-continued

| Element or Player: | Description: |
|---|---|
| 14 | Center of Game Board |
| 16 | Beginning Position of Carrier Piece on Game Board |
| 18 | Beginning Position of Escort Piece on Game Board |

Detailed Description of Method of Play and Rules

Figure 2:
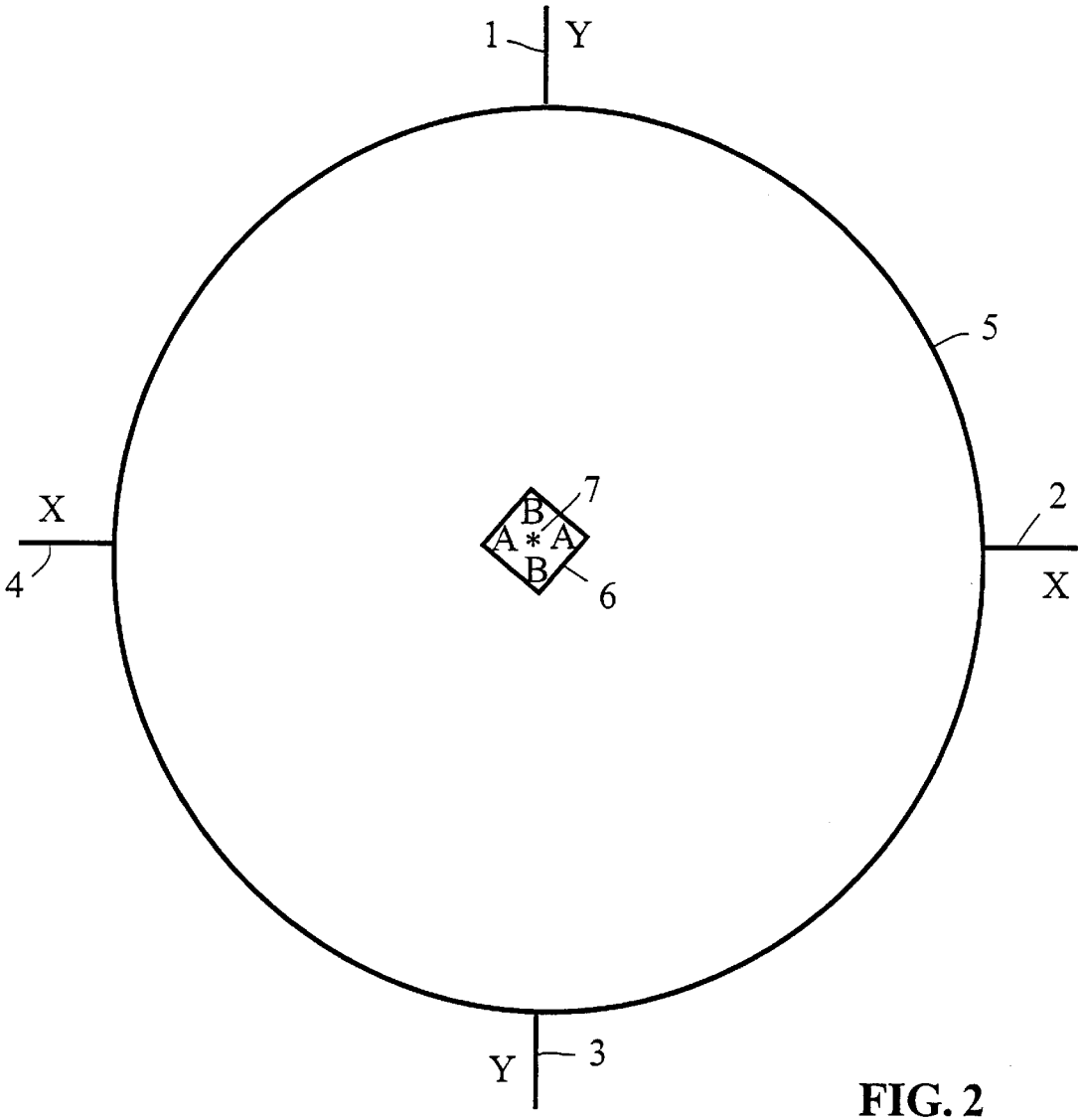
FIG. 2 is a diagrammatic top plan view of the playing field showing eight (8) players in the designated starting positions.

FIG. 1 shows a playing field including two (2) teams of two (2) players each. FIG. 2 shows a playing field including two (2) teams of (4) players each. Although there is not a limit on the number of players per team, the number of team members on each side must be an even number and the number of team members on each side must be equal. In FIG. 1 and in FIG. 2, the players are shown in the initial starting position at the beginning of a round of play.

Refer now to FIG. 1 where the offensive players X, Y and the defensive players A, B are shown in their initial positions at the beginning of a round of play. The defensive players A, B are positioned inside of the center marker 6 while the offensive players X, Y are positioned along the perimeter 5 of the playing area. Each of the offensive players X, Y is positioned at a separate hash mark 1, 2, 3 or 4. Inside of the center marker 6 is a playing object 7 indicated in FIGS. 1, 2 with an asterisk.

The offensive players are further defined to include a carrier X and an escort Y. The carrier's objective is to carry the playing object 7 outside of the perimeter 5 of the playing area. The escort's objective is to tag the defensive players A, B. The defensive players A, B objective is to tag-out the carrier X before the carrier X can carry the playing object 7 outside of the perimeter 5. When a player is tagged-out he or she may no longer participate in that round of play and they must leave the perimeter 5 of the playing area at the closest point. When a player is tagged-out, he or she must announce to the other players that they are out. The announcement must be loud enough for all of the players to hear. A tag must be made with the hands, but only a single hand is required for a valid tag. Chalk or other marking material may be used to verify tags.

The playing object 7 may be a ball or any other desired object which can be carried by the carrier A.

Prior to beginning a round of play, the offensive team must identify who will be playing the role of the carrier. A round of play begins upon the initiation of an appropriate count, such as, "On Your Mark, Get Set, Go!". Immediately upon the beginning of the round of play, the offensive players X, Y enter the perimeter 5 of the playing area. The carrier X then attempts to remove the playing object 7 from the center marker 6 while the escort Y attempts to block the carrier X from being tagged-out by either of the defensive players A, B while simultaneously attempting to tag-out the defensive players.

Several different events may end the round of play, namely:

- if either defender A, B tags-out the carrier X,
- if the carrier X steps outside of the playing perimeter 5 before retrieving the playing object 7,
- if the carrier X drops or attempts to throw the playing object 7,
- if all of the defenders A, B are tagged-out by the escort Y before the carrier X is tagged, if the carrier X successfully removes the playing object 7 from the playing area, or if an escort touches the playing object.

If none of the ending events occur, then a round automatically ends after ninety (90) seconds of play. It is envisioned that during tournament play, a neutral judge will be available to verify the ending events, compliance with rules, timing and any other appropriate administrative or organizational matters.

Points are only earned by the offensive team X, Y. The offensive team X, Y earns a point if the carrier X successfully carries the playing object 7 outside of the perimeter 5 of the playing area without being tagged-out by either of the defensive players A, B or if both defenders A, B are tagged-out by the escort Y.

In a four (4) player game, the value of a score varies and is determined according to the following table:

| Number of Points Scored: | Number of Defensive Players Who Have Not Been Tagged-Out: |
|---|---|
| 3 | 2 |
| 2 | 1 |
| 1 | 0 (i.e. if both defensive players are tagged-out by the escort Y) |

If the offensive team does not score, then the teams switch roles. In other words, the offensive team becomes the defensive team and the defensive team becomes the offensive team. Only the carrier(s) X are allowed to touch the playing object. If an escort Y touches the playing object, the round is ended and the teams switch roles. Further, the offense is awarded the maximum amount of points available at the time of the illegal contact. The first team to score fourteen (14) points wins the game. However, if desired the winning score can be prearranged by the team representatives before beginning the game.

Refer now to FIG. 2, where an eight (8) player embodiment of the present inventive game is illustrated. In the eight (8) player embodiment, there are four (4) players on the offense X, Y, X, Y and four (4) players on the defense A, B, A, B. The offensive team members X, Y, X, Y line up next to the hash marks 1, 2, 3, 4 before the beginning of a round of play. The defensive players A, B, A, B line up inside of the center marker. The number of players who can play in the game is not limited except that there must be an even and equal number of players on offense and on defense. As an additional option, there can be as many playing objects 7 as there are carriers X.

The rules of play for an eight (8) player embodiment of the present inventive game are the same as for a four (4) player embodiment. However, instead of a single carrier A and a single escort B, there are two (2) carriers A, and two (2) escorts B. The roles and objective of the carriers A and escorts B are the same in an eight (8) player game as they are in a four (4) player game. A difference also exists between the scoring value in an eight (8) player game compared with the scoring of a four (4) player game.

In an eight (8) player game, the point value of a score is determined according to the following table:

| Number of Points Scored: | Number of Defensive Players Who Have Not Been Tagged-Out: |
|---|---|
| 5 | 4 |
| 4 | 3 |

-continued

| Number of Points Scored: | Number of Defensive Players Who Have Not Been Tagged-Out: |
|---|---|
| 3 | 2 |
| 2 | 1 |
| 1 | 0 (i.e. if all four (4) defensive players are tagged-out by the escorts Y) |

Figure 3:
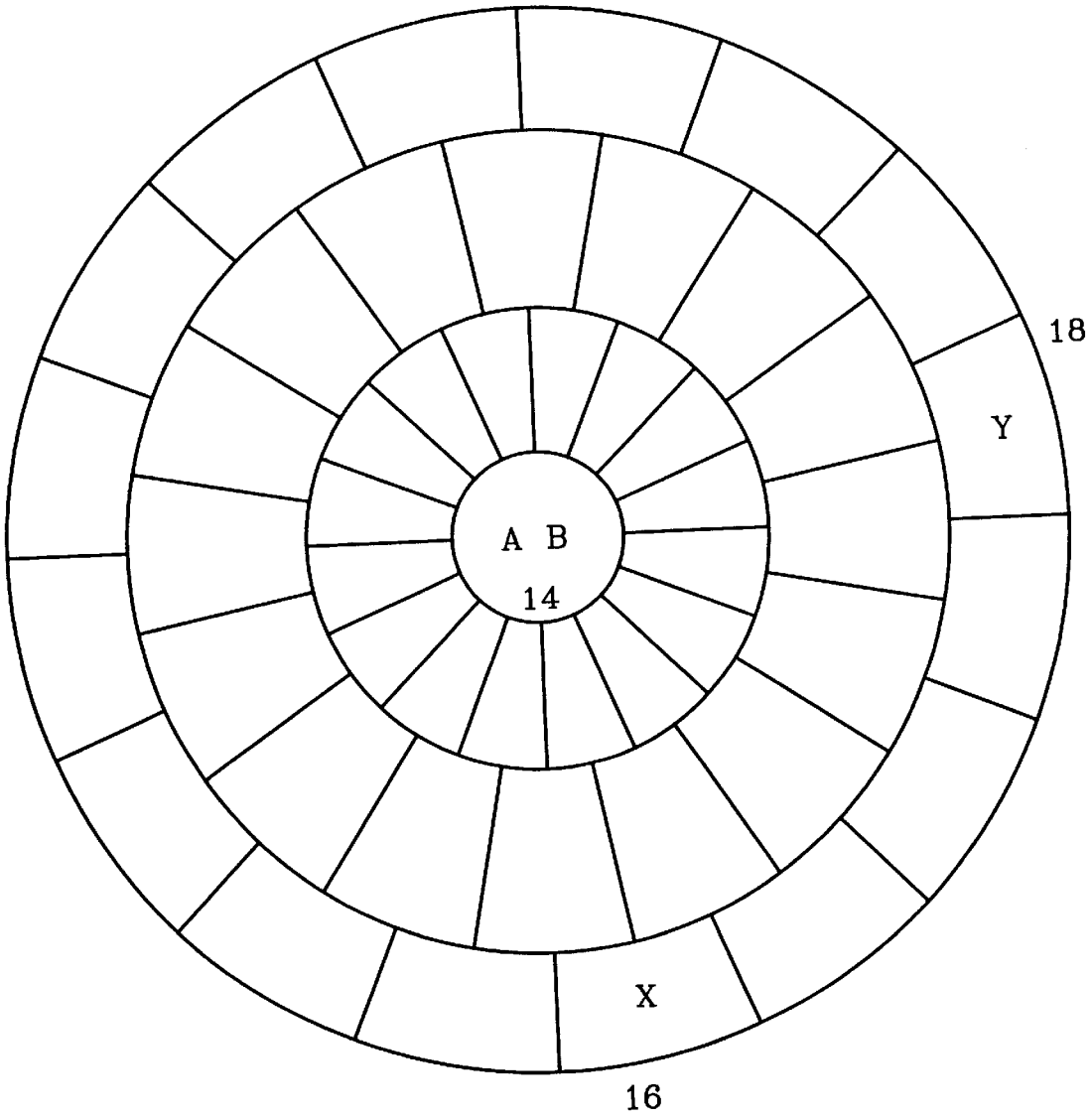
FIG. 3 is a diagrammatic top plan of the game board on which the disclosed game is played.

In another preferred embodiment, the game is played on a board instead of a field. FIG. 3 illustrates a diagrammatic top view of the game board on which the inventive game is played. The game board includes a center circle 14 on which the defensive players A, B are positioned at the beginning of play. The offensive players X, Y are positioned approximately ninety (90) degrees apart in the spaces designated in FIG. 3 as 16, 18; respectively. As in the field game, the offensive pieces are divided into a carrier piece X and an escort piece Y.

At the beginning of play during the board game, the carrier piece X moves a single space in any direction toward the center of the playing board 14. Then a defensive player piece A, B moves a single space with the objective of intercepting the carrier piece X. The carrier piece X is intercepted if a defensive player piece A, B lands on the carrier piece's space. Next, the escort piece Y moves in an attempt to prevent a defensive player piece A, B from intercepting the carrier piece X. This sequence repeats with the defensive player pieces A, B, carrier piece X and escort piece Y alternating in turn so that each player piece has an opportunity to move.

If an escort piece Y lands on a defensive player piece A, B, the defensive player piece A, B is eliminated from the game. The defensive player pieces A, B are controlled by a single player. The offensive player pieces X, Y are controlled by another single player.

The game is concluded when one of the following events occurs:

the carrier piece X successfully lands on the center of the board 14; or the carrier piece X is eliminated by a defensive piece A or B; or both defensive pieces A, B are eliminated by the escort piece Y.

Because many varying and different embodiments may be made within the scope of the inventive concept herein taught, and because many modifications may be made in the embodiments and methods herein detailed in accordance with the descriptive requirement of the law, it is to be understood that the details herein are to be interpreted as illustrative and not in a limiting sense.

What is claimed is:

1. In a field game played on a substantially flat surface having a playing area defined by a perimeter in which two teams oppose each other, one of said teams being offensive and the other of said teams being defensive, said number of offensive team members equals the number of defensive team members, said number of team members on each side is divisible by two, wherein the method of playing comprises the steps of:

a. Dividing said offensive team into two groups, wherein one of said groups acts as one or more carriers and the other of said groups acts as one or more escorts;

b. Positioning said defensive team members in close proximity to a predetermined object on said playing area;

c. Positioning said offensive team members in close proximity to the perimeter of said playing area;

d. Beginning game when a mutually understood signal is announced;

e. Attempting by said one or more carriers to remove a playing object from the perimeter of said playing surface before being tagged-out by any member of said defensive team;

f. Attempting by any member of said defensive team to tag-out said one or more carriers;

g. Attempting by said one or more escorts to tag-out said any member of said defensive team;

h. Continuing play until a predetermined triggering event occurs.

2. A method of playing a field game as claimed in claim 1 wherein the perimeter of said substantially flat surface is annular in shape and wherein said annular shape forms the playing area.

3. A method of playing a field game as claimed in claim 2 wherein any player who leaves said playing area may not return to that round of play.

4. A method of playing a field game as claimed in claim 1 wherein said escorts are separated from said carriers by at least approximately ninety degrees.

5. A method of playing a field game as claimed in claim 1 wherein said predetermined object is positioned substantially close to the center of the playing area prior to beginning a round of play.

6. A method of playing a field game as claimed in claim 1 wherein said predetermined triggering event is selected from the group consisting of:

a. when one or more carriers remove said playing object from said playing area, b. when said defensive players tag-out all of the carriers, c. when said one or more carriers step outside of the playing area before retrieving said playing object, d. when said one or more carriers drops or attempts to throw said playing object, e. when all defensive players are tagged-out by said one or more escorts, and f. when said one or more carriers removes said playing object from said playing area.

7. A method of playing a field game as claimed in claim 1 wherein there are the same number of playing objects as there are carriers.

8. A method of playing a field game as claimed in claim 1 wherein said playing object is a ball.

9. In a board game played on a substantially flat playing surface having a playing area on which two teams of player pieces oppose each other, said playing area being divided into multiple concentric circles having multiple spaces indicated thereon, one of said teams being offensive and the other of said teams being defensive, said number of offensive players and defensive players on each side is two, wherein the method of playing comprises the steps of:

a. Dividing said offensive team in two, wherein one of said offensive players acts as a carrier and the other of said players acts as an escort;

b. Positioning said defensive players in the center circle of said playing area;

c. Positioning said offensive players on the outside circle of said playing area;

d. Moving said carrier at least one space in any direction;

e. Moving a first defensive player at least one space in any direction;

f. Moving said escort at least one space in any direction;

g. Moving the second defensive player at least one space in any direction;

h. Continuing the sequence of play in steps d through g until a predetermined triggering event occurs.

10. The method of playing a board game as claimed in claim 9 wherein a defensive player is eliminated from the game if the escort lands on the defensive player's space and wherein the carrier is eliminated if a defensive player lands on the carrier's space.

11. The method of playing a board game as claimed in claim 9 wherein said predetermined triggering event is selected from the group consisting of:

a. when the carrier player lands on said center circle, b. when the carrier is eliminated by a defensive player, and c. when both defensive players are eliminated from play.

* * * * *